US008707470B1

(12) United States Patent
Novicky et al.

(10) Patent No.: US 8,707,470 B1
(45) Date of Patent: Apr. 29, 2014

(54) ENHANCED IMPACT ABSORPTION STRIPS FOR PROTECTIVE HEAD GEAR

(75) Inventors: Steven D. Novicky, Canfield, OH (US); Lindsey Erin Frick, Lakewood, OH (US)

(73) Assignee: SK Adventures, LLC, Canfield, OH (US)

( * ) Notice: Subject to any disclaimer, the term of this patent is extended or adjusted under 35 U.S.C. 154(b) by 608 days.

(21) Appl. No.: 12/931,030

(22) Filed: Jan. 24, 2011

Related U.S. Application Data

(60) Provisional application No. 61/398,482, filed on Jun. 25, 2010.

(51) Int. Cl.
*A42B 1/22* (2006.01)

(52) U.S. Cl.
USPC ..... 2/411; 267/152

(58) Field of Classification Search
USPC ..... 267/152, 153; 2/410–414
See application file for complete search history.

(56) References Cited

U.S. PATENT DOCUMENTS

| | | | | |
|---|---|---|---|---|
| 3,174,155 | A | 3/1965 | Pitman | |
| 3,251,076 | A * | 5/1966 | Burke | 428/116 |
| 4,937,888 | A | 7/1990 | Straus | |
| 5,309,576 | A * | 5/1994 | Broersma | 2/412 |
| 5,669,079 | A * | 9/1997 | Morgan | 2/414 |
| 5,713,082 | A | 2/1998 | Bassette et al. | |
| 5,724,681 | A | 3/1998 | Sykes | |
| 5,950,244 | A * | 9/1999 | Fournier et al. | 2/414 |
| 6,272,692 | B1 | 8/2001 | Abraham | |
| 6,282,724 | B1 | 9/2001 | Abraham et al. | |
| 6,314,586 | B1 | 11/2001 | Duguid | |

* cited by examiner

*Primary Examiner* — Christopher Schwartz
(74) *Attorney, Agent, or Firm* — Harpman & Harpman

(57) ABSTRACT

An integrated impact energy absorption system application for enhanced safety performance of sports related protective head gear. A multiplicity of pattern positioned energy shock absorption impact strips of high performance dual elastomeric polyurethane resin of the invention are selectively secured in a pattern orientation on a sports helmet to protect critical vulnerable locations on the exterior thereof. Preformed impact absorption strips are of a composite construction having internalized compartment energy attenuating cells in a repetitive matrix construction for enhanced forced absorption and deflection to the helmet surface to which they are so secured.

10 Claims, 4 Drawing Sheets

ENHANCED IMPACT ABSORPTION STRIPS FOR PROTECTIVE HEAD GEAR

This application claims the benefit of U.S. Provisional Application No. 61/398,482, filed on Jun. 25, 2010.

BACKGROUND OF THE INVENTION

1. Technical Field

This invention relates to protective head gear used in a variety of sports venues to protect against head related injuries caused by impact forces, including micro-traumatic brain injuries, received thereto during use.

Sports related head injuries are a growing problem in organized sports, such as football even with the required mandatory use of helmets, head injuries occur in increasing numbers in frequency. Research has indicated that not only a single high energy impact to the head is responsible for player's brain concussion, but just as important is the repetitive accumulative damage that the player receives by multiple head impacts over time, also known as micro-traumatic brain injuries. A number of factors influence the increased rates of head impacts during play including the evolution of the style of tackling and running and blocking has changed. Modern player style leads to higher head injury rates wherein players suffer more multiple mild to severe concussions in the course of play than in the past.

2. Description of Prior Art

Protective head gear typical helmets have been developed and worn by individuals in many sports activities to protect the user from penetration impact to the user's head by multiple angular impacts thereto.

Prior art helmets typically have a hard outer casing with a padded interior in direct contact with the player's head. Such helmets generate an initial high impact shock wave from their hard outer casing in an attempt to mitigate it by the internal layer or layers of shock absorbing material.

A number of prior art patents have attempted to address this issue by modifying the impact surface of the helmet, see for example U.S. Pat. No. 3,174,155 which discloses a protective monolithic helmet pad positioned over the top of the helmet.

U.S. Pat. No. 4,937,888 illustrates a helmet cover for encasing the helmet with a thick layer of resilient foam.

U.S. Pat. No. 5,713,082 discloses a sports helmet having a rigid shell with an outer soft covering thereover to absorb impacts.

U.S. Pat. No. 5,724,681 describes a form fitting protective cover apparatus for a helmet overlying the entire surface thereof.

U.S. Pat. No. 6,272,692 shows an improved protective head gear having a number of preformed protective pads that are removably affixed to areas on the outer surface of the helmet.

U.S. Pat. No. 6,282,724 claims an apparatus for enhancing absorption and dissipation of impact forces on a helmet. The apparatus has a protective pad having a rigid or semi-rigid insert sandwiched by soft pad material thereabout.

Finally, in U.S. Pat. No. 6,314,586 a supplemental protective pad is disclosed for a sports helmet wherein a pad is formed with a number of upstanding protrusions of varying shapes and sizes to compress and absorb energy upon impact.

SUMMARY OF THE INVENTION

The present invention relates to sports helmets and an impact absorption and deflection device that provides a flexible force transfer medium selectively affixed to the exterior of the helmet. The device has enhanced performance criteria by combining elastomeric synthetic resin compound materials of different performance properties forming inter-conforming matrix of energy absorbing air cells therewithin. The cells afford interior configurations interlinked together with common walls for absorptive deflective properties.

DETAILED DESCRIPTION OF THE INVENTION

Figure 1:
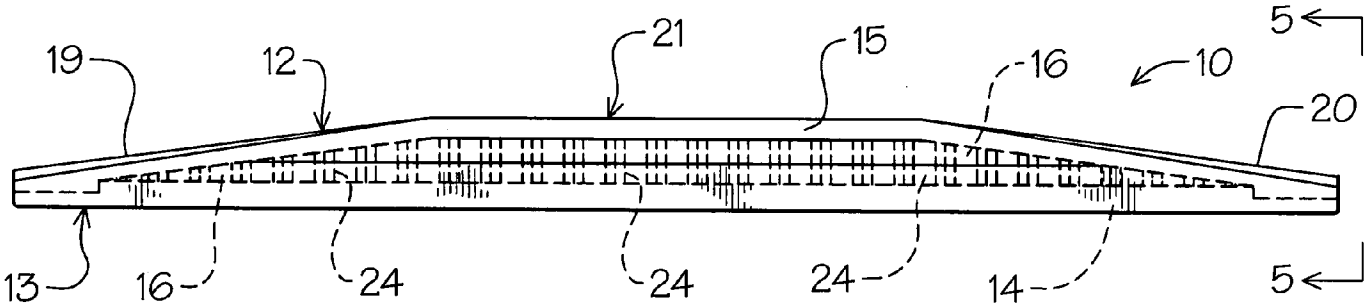
FIG. 1 is a side elevational view of an enhanced impact absorption strip.

An impact absorption strip and deflection device 10 of the invention can be seen in FIGS. 1-4 of the drawings, in the form chosen for illustration, an elongated generally rectangular body member 11 with a contoured top surface 12 and oppositely disposed parallel flat textured material attachment bottom surface 13.

A support base insert closure portion 14 and an upper impact engagement portion 15 are bonded permanently together to form an integrated composite performance structure.

The upper engagement portion 15 has a plurality of hexagonal shaped recesses 16 therewithin defined by a matrix of corresponding interconnected hexahedral defined walls 17 referred to generally as a honeycomb configuration in which shared walls define an A-typical honeycomb pattern and the hexagonal recesses 16 therebetween defining independent air cells 16A.

Figure 3:
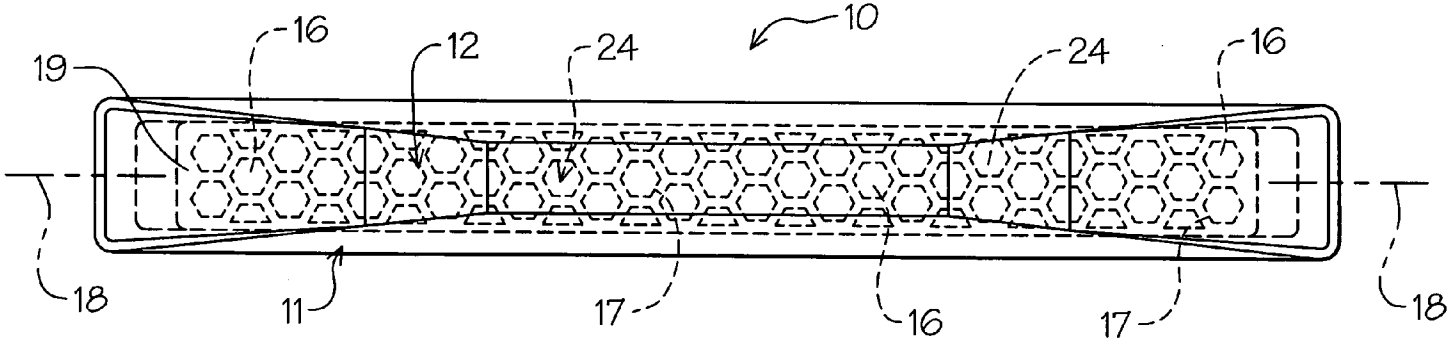
FIG. 3 is a top plan view of enhanced impact absorption strip for protective head gear.
Figure 6:
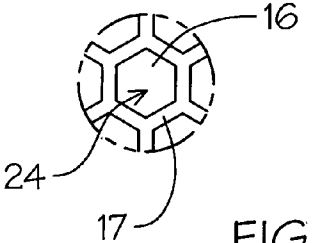
FIG. 6 is an enlarged graphic view of the interior honeycombed walled energy absorption deflective pattern defining air cells within the strip.
Figure 4:
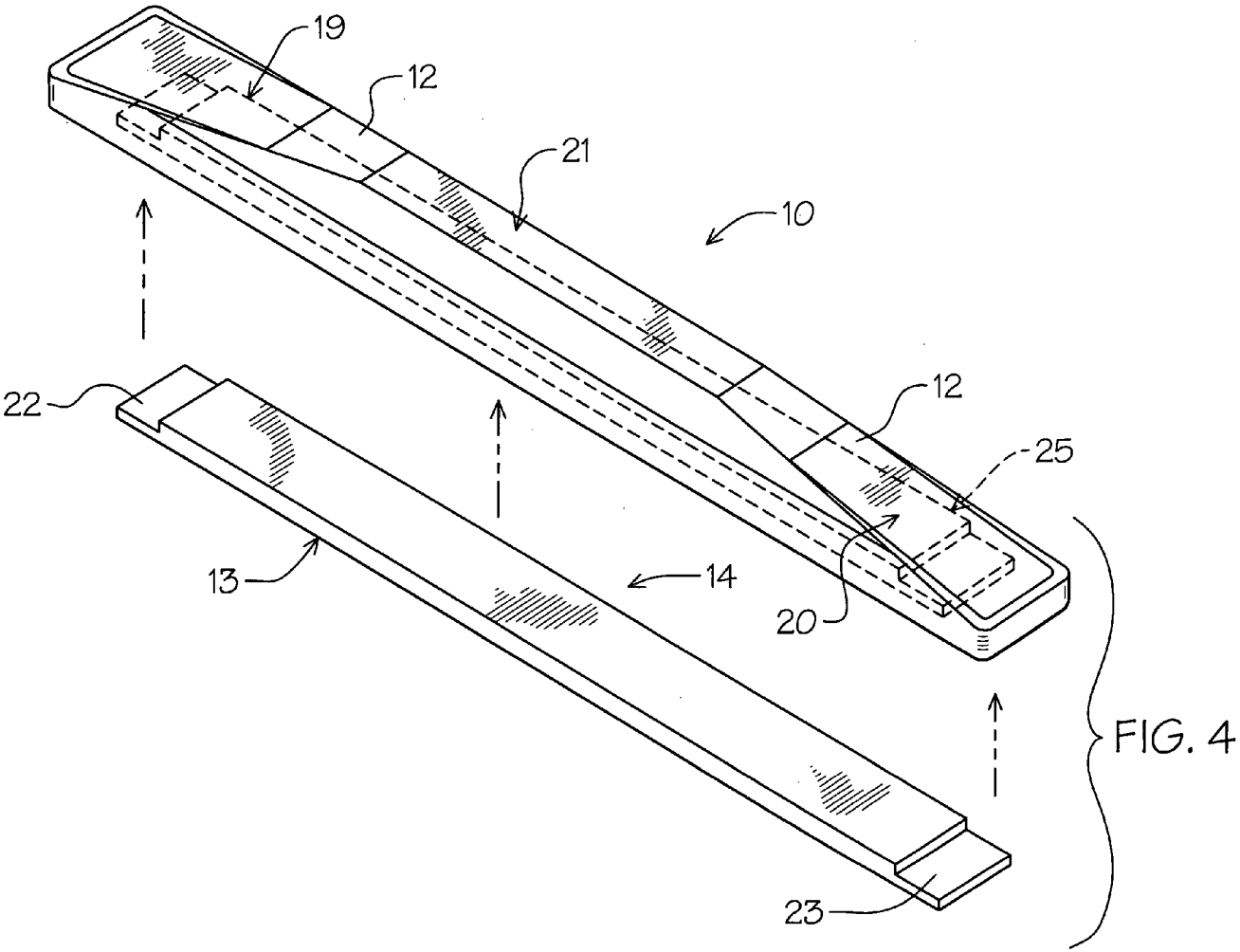
FIG. 4 is an exploded view of the impact absorption strip prior to assembly.

The walls 17 and so defined hexagonal shaped recesses 16 can best be seen in FIGS. 3 and 6 of the drawings in enlarged detail. In this example, the formed honeycomb wall pattern is oriented to begin centrally, midway along the longitudinal axis 18 within of the upper portion 15 as being offset translaterally to accommodate the end contours 19 and 20 of the top surface 12 as seen in FIG. 4 of the drawings.

The end contours 19 and 20 are tapered for directional exterior impact occurring during use as will be described in greater detail hereinafter.

Figure 2:
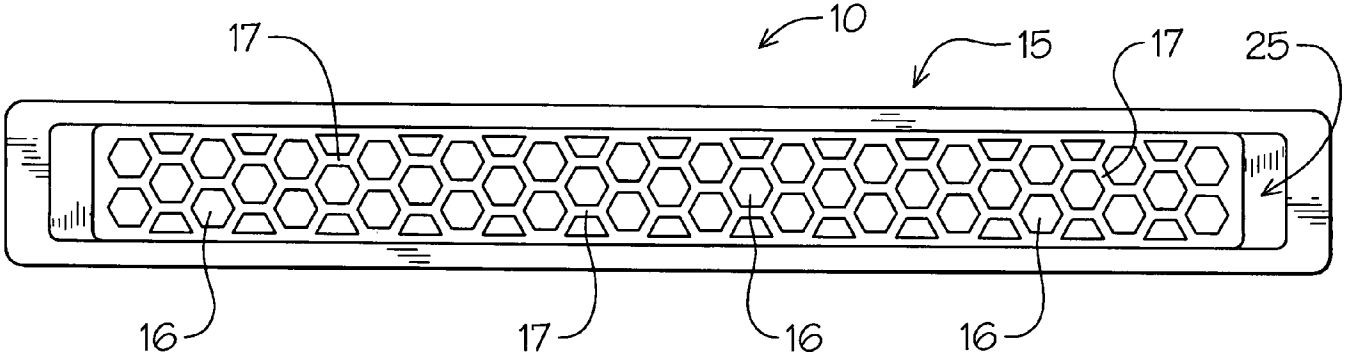
FIG. 2 is a bottom plan view thereof.
Figure 5:
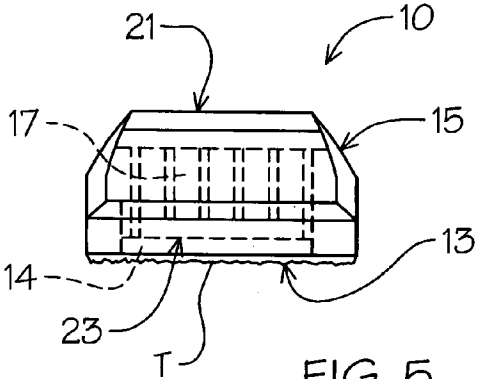
FIG. 5 is an enlarged end view thereof.

As so illustrated, the walls 17 and inter-defined recesses 16 extend beyond an overlying top planar surface 21 of the contoured top surface 12 and will therefore be enclosed within the engagement portion 15 by the base portion 14, best seen in FIGS. 1 and 5 of the drawings. The base portion 14 is of a rectangular configuration having the flat textured attachment bottom surface 13 which is micro textured T to enhanced adhesive application and performance. The base portion 14 has oppositely disposed recessed end tabs 22 and 23 of a dimension and mating character for aligning and receiving in registration with a corresponding recessed bottom surface 25 of the top portion 15 as seen in FIGS. 2 and 4 of the drawings Correspondingly, a plurality of hexagonal shaped sealed air cells 24 are formed therewithin once the upper engaged portion 15 and the support base portion 14 are bonded together along their abutting co-planar surfaces as will be well understood by those skilled in the art. It will be evident that while thermal bonding is a preferable joining method for materials of this nature, other bonding techniques may be used to achieve the integrated engagement of the surfaces and to afford the sealing nature to define the corresponding cells 24.

The strip 10 of the invention is preferably formed of molded synthetic resin material, such as polymer (e.g. the visco-elastic polymer known in the trade as Akton® a registered trademark of Action Products, Inc., of Hagerstown, Md.), having varied elastomeric properties It will be apparent to those skilled in the art that while the honeycomb defined hexagonal walled 17, sealed air cells 24 configuration are of an efficient structural nature in this application, other cell wall patterns could be substituted well within the performance parameters of the known disclosure.

Additionally, in some applications the honeycomb pattern or variance thereof could be eliminated wherein the upper portion 15 and bonded support base portion 14 may define an inner chamber in place of the cells 24 that may contain in various embodiments liquid, semi-liquid (i.e. gel material) or even a gaseous envelope or medium.

The impact absorption strips 10 for protective head gear of the invention may also be formed of a monolithic construction imparted by material choice and advanced resin molding methods to afford similar performance characteristics and therefore such constraints will not limit the scope of the disclosure.

The upper impact engagement portion 15, as noted, is of an elastomeric polyurethane resin that may have a softer durometer than that chosen for the support base portion 14. The upper portion 15 (by having a "softer" elastomeric material to quickly absorb and then deflect impact energy) and the base support portion 14 (by having a harder durometer material for increased tensile strength) combine together to optimally allow for required application deflection while conforming to the contours and maintaining adhesion to a sport helmet 26 to which it is applied as illustrated graphically in FIGS. 7 and 8 of the drawings.

Figure 7:
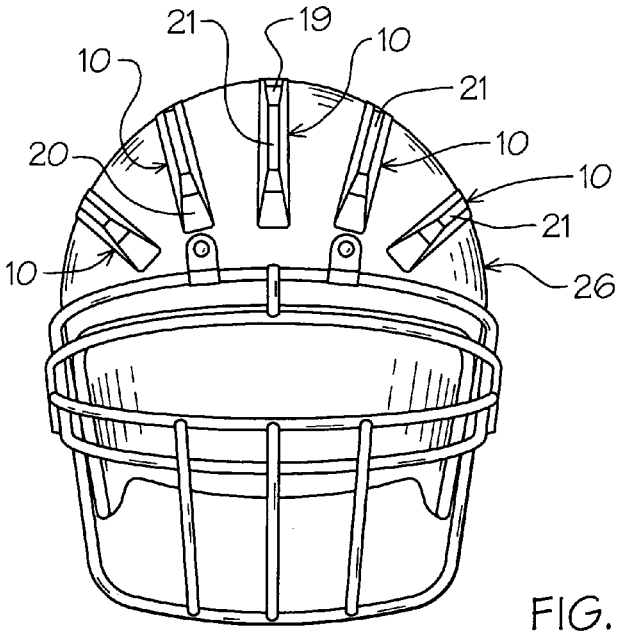
FIG. 7 is a front elevational view of a sports helmet representation with the impact absorption strips attached thereto in pattern orientation.
Figure 8:
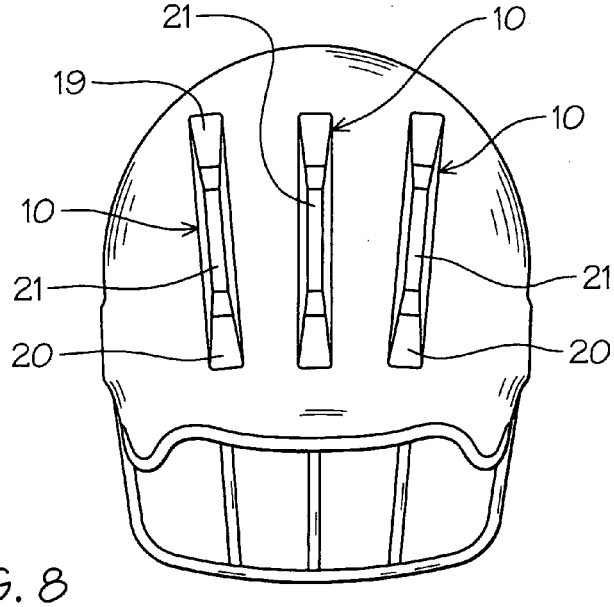
FIG. 8 is a rear elevational view thereof illustrating a placement example of the absorption strips.

The universal utility imparted by the materials and design choices of the impact absorption strips 10 for protective head gear allows for a variety of mounting pattern placements on the helmet 26 generally illustrated in FIGS. 7 and 8 of the drawings. Such attachment is achieved by any one of a number of commercially available adhesives applied to the attachment bottom textured surface 13 of the strips 10.

The illustrated placement pattern of the strips 10 imparts their versatility having the contoured top surface 12 defined by the respective tapered end surfaces 19 and 20 and a flat top area 12A of reduced transverse dimension as illustrated best in FIG. 1 of the drawings. These structural configurations additionally help to maintain the attachment of the strips 10 under the high kinetic energy impact field imparted during sports play contact.

While the preferred embodiment elastomeric polyurethane materials chosen are of a transparent nature, a number of opaque colorized resins may be used depending on user venue and desired aesthetic effect requested.

It will thus be seen that a new and novel enhanced impact absorption strip for protection head gear has been illustrated and described and it will be understood by those skilled in the art that various changes and modifications may be made thereto without departing from the spirit of the invention.

We claim:

1. A surface impact energy absorption apparatus comprising, an absorption deflection strip selectively attached to the exterior surface of protective sports equipment, said strip comprising, a contoured upper engagement portion having a continuous flat top surface with oppositely disposed tapered top surfaces of reduced transverse dimension, a matrix of interconnected walls formed within said upper engagement portion in spaced relation to said respective top and end top surfaces defining a plurality of open recesses therewithin, an integrated base closure portion overlying said interconnected walls sealing said open recesses defining multiple energy absorbing cells, said base closure portion having a flat walls engagement surfaces and an oppositely disposed parallel flat equipment engaging surface.

2. The surface impact energy absorption apparatus set forth in claim 1 wherein said upper engagement portion has an elongated recess in communication with said interconnected walls.

3. The surface impact energy absorption apparatus set forth in claim 2 wherein said base portion has oppositely disposed recess end tab surfaces, and is registerable within said upper engagement portion elongated recess in co-planar alignment therewithin.

4. The surface impact energy absorption apparatus set forth in claim 1 wherein said matrix of interconnected walls are hexagonal shaped.

5. The surface impact energy absorption apparatus set forth in claim 1 wherein said contoured upper engagement portion and said integrated base closure portion are molded of synthetic resin visco elastic polymer material.

6. The surface impact energy absorption apparatus set forth in claim 1 wherein said absorption deflection strip is selectively attached to exterior surface of said protective sports equipment by adhesive on said flat equipment engaging surface of said base portion.

7. The surface impact energy absorption apparatus set forth in claim 1 wherein said base portion flat equipment engaging surface is micro textured.

8. The surface impact energy absorption apparatus set forth in claim 1 wherein multiple absorption deflection strips are attached to previously existing sport helmets in multiple spaced pattern orientation to one another.

9. The surface impact energy absorption apparatus set forth in claim 1 wherein each of said energy absorbing cells of a hexagonal shape with common enclosure walls.

10. The surface impact energy absorption apparatus set forth in claim 1 wherein said multiple sealed energy absorbing cells are of a combined surface area greater than that of said upper flat engagement surface of said compound contoured upper engagement surface.

* * * * *